United States Patent [19]

Molins

[11] 4,093,496

[45] June 6, 1978

[54] APPARATUS FOR ASSEMBLING ROD-LIKE ARTICLES

[75] Inventor: Desmond Walter Molins, London, England

[73] Assignee: Molins Limited, England

[21] Appl. No.: 672,148

[22] Filed: Mar. 31, 1976

[30] Foreign Application Priority Data

Apr. 4, 1975 United Kingdom ..... 13823/75

[51] Int. Cl.[2] ..... B65C 9/04

[52] U.S. Cl. ..... 156/449; 93/1 C; 93/77 FT; 131/61 R; 131/88; 156/158; 156/259; 156/456; 156/517; 156/559; 156/567

[58] Field of Search ..... 93/1 C, 77; 131/10 R, 131/10.7, 20 R, 61 R, 88, 94; 156/158, 159, 215, 259, 266, 296, 449, 450, 456, 458, 517, 559, 562, 567, 260, 320; 226/197

[56] References Cited

U.S. PATENT DOCUMENTS

| | | | |
|---|---|---|---|
| 2,524,945 | 10/1950 | Vonhofe | 156/320 |
| 3,039,367 | 6/1962 | Stelzer | 131/94 |
| 3,199,418 | 8/1965 | Schubert | 93/1 C |
| 3,368,460 | 2/1968 | Schubert | 93/1 C |
| 3,576,695 | 4/1971 | Stine | 156/517 |
| 3,809,593 | 5/1974 | Burke et al. | 156/260 |
| 3,961,633 | 6/1976 | Schubert et al. | 93/1 C |

FOREIGN PATENT DOCUMENTS

| | | | |
|---|---|---|---|
| 815,344 | 6/1959 | United Kingdom | 226/197 |
| 886,657 | 1/1962 | United Kingdom. | |
| 1,019,092 | 2/1966 | United Kingdom. | |

*Primary Examiner*—William A. Powell
*Attorney, Agent, or Firm*—Craig & Antonelli

[57] ABSTRACT

Composite filter rods, from which composite filters for attachment to cigarette lengths are obtained, are produced by joining component filter portions with uniting bands which overlap the end portions only of adjacent filter portions. The uniting bands are obtained by longitudinally slitting a web of wrapping material into strips, spacing the strips by passing each strip around spaced turner bars, and finally severing the strips on a rolling drum. The component filter portions are conveyed transversely in aligned groups to a rolling plate which cooperates with the rolling drum to wrap a uniting band around each junction between adjacent filter portions in a group.

2 Claims, 9 Drawing Figures

APPARATUS FOR ASSEMBLING ROD-LIKE ARTICLES

This invention relates to a method and apparatus for assembling rod-like articles, and in particular to the formation of a composite filter rod from which composite filters, for incorporation in filter cigarettes, can be obtained by cutting the rod at appropriate positions.

It is common for cigarettes to consist of a tobacco filler portion and an adjoining mouthpiece portion. Cigarettes of this type are herein referred to as "filter cigarettes" and mouthpieces are referred to as "filters," irrespective of the filtering action, if any, which the mouthpiece may perform. For example, a filter or part of a filter may comprise a tube.

Composite filters are known in which each filter comprises at least two axially adjacent portions of different filter material. For example, a common construction of a composite (dual) filter has a portion consisting of a prewrapped plug of paper-like material and a portion consisting of a tow of cellulose acetate fibres or other suitable fibrous material.

It is already known to form a composite filter rod by assembling double-length portions of different filter materials in an alternating stream and continuously feeding the stream into the garniture of a continuous rod filter making machine where it is enclosed in a continuous wrapper web. The continuous rod formed in the garniture may be cut at positions corresponding to the mid-points of the double-length filter portions to produce individual composite filters which are joined to tobacco filler portions in any conventional manner. Alternatively, the continuous rod may be cut at the mid-points of the filter portions of one of the filter materials to produce double length composite filters. These double length filters may be placed between and joined to two tobacco filler lengths and the resulting assemblage cut at its mid-point to produce two individual filter cigarettes.

It is also known to assemble filter portions for forming into composite filter rod by cutting and spacing lengths of different filter materials on drums, and conveying the resultant filter portions so that they eventually become aligned in groups of alternating filter portions. Each group may, for example, contain alternating component filter portions from which six individual composite filter portions can be obtained. The groups of aligned component filter portions can be formed into composite filter rods by surrounding and sealing each group in a wrapper which spans the length of the group. In one known procedure the groups are conveyed transversely to their lengths and a precut piece of wrapper material rolled and sealed around the whole length of each group. Individual composite filters (or double length composite filters) may be obtained by cutting the composite filter rods at appropriate positions, preferably while the rods are moving transverse to their lengths.

The present invention is applicable to the formation of composite filter rod lengths, in contrast to the formation of continuous composite filter rod.

One aspect of the invention provides a method of forming a composite rod, comprising conveying a group of axially aligned rod-like articles transverse to its length, feeding a web of uniting material, continuously longitudinally slitting the web into a plurality of strips, feeding the strips around guide elements which are spaced in relation to the directions of travel of the strips so that said directions of travel are changed and said strips are spaced laterally apart, transversely cutting each strip into portions to provide a plurality of uniting bands, and wrapping and sealing a uniting band around the end portions of each adjacent pair of rod-like articles in a group.

The cutting and the wrapping and sealing steps are preferably carried out simultaneously for each strip. The wrapping and sealing is preferably effected by rolling the rod-like articles relative to the uniting bands. The directions of travel of the strips after passing the guide elements are preferably parallel. The change in the direction of travel for each strip may conveniently be through a right angle.

The groups of rod-like articles are preferably formed by interdigitating sub-groups of axially aligned spaced rod-like articles while said sub-groups are moving transverse to their lengths. At least one of the sub-groups is preferably formed by movement of one or more articles of the sub-group in an axial direction relative to the other article or articles of the sub-group while the sub-group is conveyed in a direction transverse to its length.

Another aspect of the invention provides apparatus for making composite filter rod, comprising means to feed successive groups each consisting of several axially aligned component filter portions, means to feed a web of uniting material, slitting means to slit the web continuously longitudinally into a plurality of strips, guide means for changing the direction of travel of said strips and for laterally spacing the strips apart, means for successively cutting portions from the strips to provide a plurality of uniting bands, and means for wrapping the uniting bands around the end portions of each adjacent pair of component filter portions of a group to join said portions into a composite filter rod.

The guide means preferably comprises a series of spaced guide elements, one for each strip, around which the strips pass. Preferably these elements are constituted by parallel turner bars which are inclined to the direction of travel of the web.

A method of making filter cigarettes in which tobacco portions are joined to filters by means of uniting bands, and in which the uniting bands are obtained from strips produced by continuously longitudinally slitting a single web of material, is described in our British patent specification No. 1,019,092.

The present invention will now be further described, by way of example only, with reference to the accompanying diagrammatic drawings in which.

Figure 5:
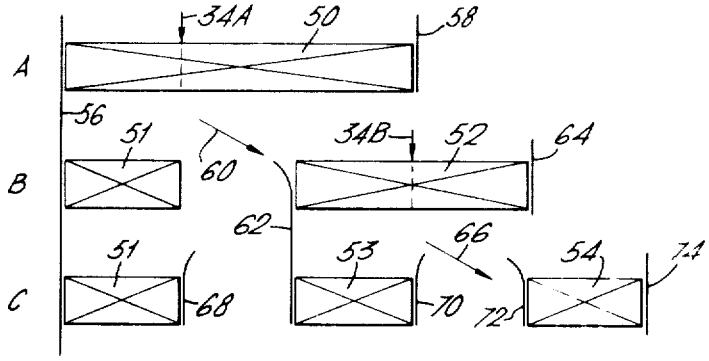
Figure 6:
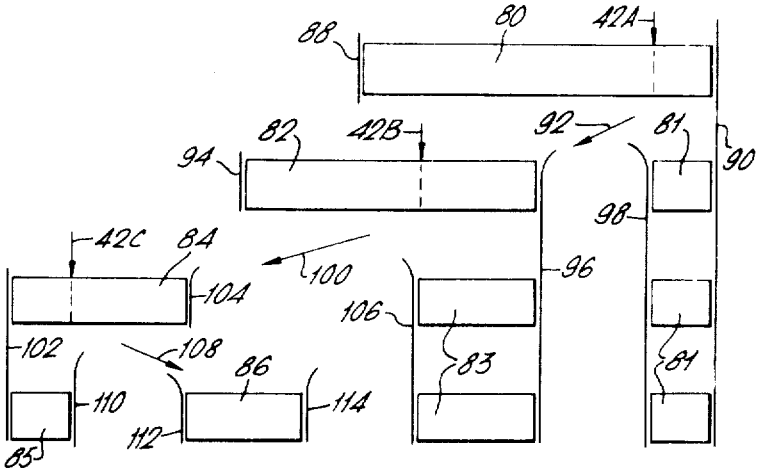
Figure 7:
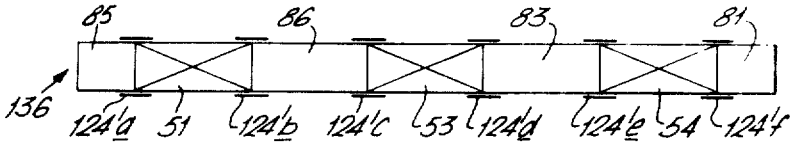
Figure 3:
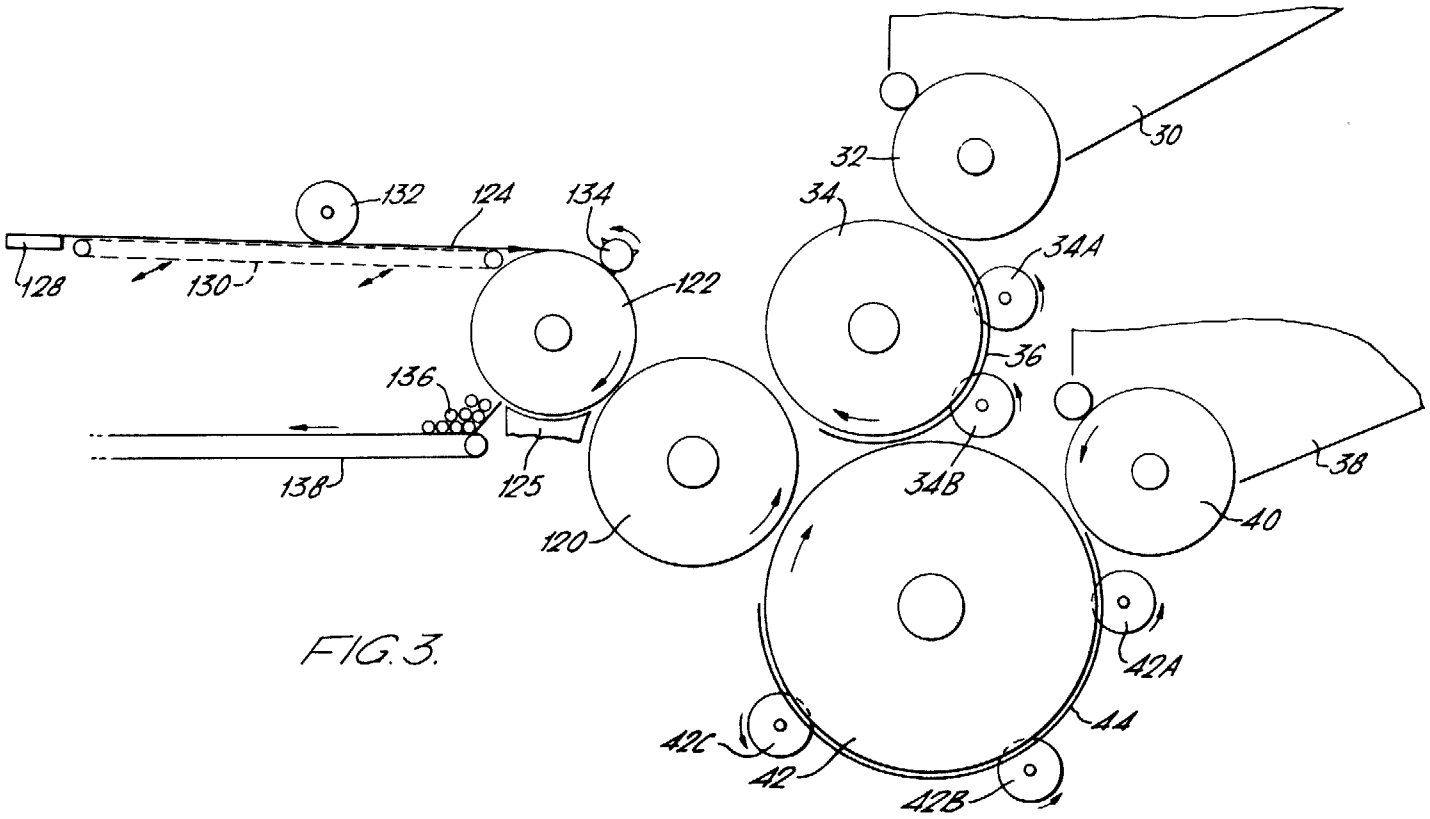
FIG. 3 shows apparatus for producing composite filter rod.
Figure 8A:
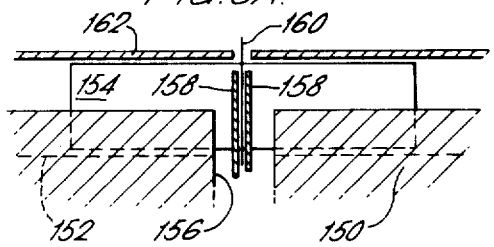
Figure 8B:
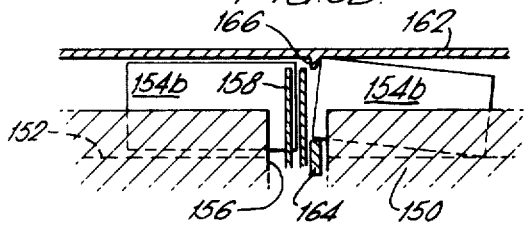

FIG. 5 shows stages in the assembly, in the apparatus of FIG. 3, of component filter portions of one filter material, FIG. 6 shows stages in the assembly, in the apparatus of FIG. 3, of component filter portions of another filter material, FIG. 7 shows a composite filter rod produced by the apparatus of FIG. 3, and FIGS. 8A and 8B are angularly spaced detail sectional views of part of a cutting and spacing drum of the apparatus of FIG. 3.

Figure 1:
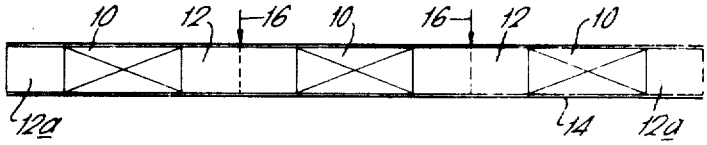
FIG. 1 shows a composite filter rod.

FIG. 1 shows a known type of composite filter rod comprising three double length component filter portions 10 of a first filter material, two double length component filter portions 12 of a second filter material and two single length component end filter portions 12*a* also of the second filter material. The filter portions 10, 12 and 12*a* are disposed in axial abutment and are wrapped and sealed in a wrapper 14 which extends the length of the rod.

In use, the rod of FIG. 1 is cut into three double length composite filters by cutting the rod at the mid-points of the portions 12, as indicated at 16. Each of these double length filters is placed between and joined to two axially aligned tobacco filler lengths. A cut is then made at the mid-point of the portion 10 to produce individual filter cigarettes.

Figure 2:
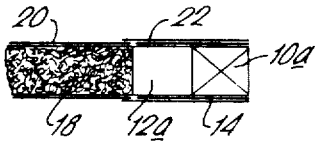
FIG. 2 shows a composite filter attached to a tobacco filler length.

FIG. 2 shows part of a filter cigarette having a composite filter. The filter comprises a single length filter component 12*a* and a single length filter component 10*a*, wrapped in a wrapper 14. The filter is in axial abutment with a tobacco section 18 enclosed in a wrapper 20. A uniting band 22, which extends the whole length of the composite filter and overlaps onto the end of the tobacco section wrapper 20, joins the filter to the tobacco section.

Referring now to FIG. 3, the apparatus illustrated produces composite filter rods in accordance with the invention, having a different construction to the rod of FIG. 1. Filter rods of a first type of filter material are delivered from a hopper 30 and its associated delivery drum 32 into successive flutes of a first cutting and spacing drum 34. Axially offset rotary cutting knives 34A and 34B extend into circumferential grooves in drum 34 and are operative to divide the first rods in the flutes of drum 34. An arcuate guide shroud 36 surrounds part of the periphery of drum 34 and carries guide elements for moving filter portions axially.

Filter rods of a second type of filter material are delivered from a hopper 38 and its associated delivery drum 40 into successive flutes of a second cutting and spacing drum 42. The drum 42 has three axially spaced circumferential grooves into which rotary cutting knives 42A, 42B and 42C extend. As with drum 34, an arcuate guide shroud 44 surrounds part of the periphery of the drum 42 and carries guide elements for moving filter portions axially.

Operation of the cutting and spacing drums 34 and 42 will now be described in detail. Referring at first to FIG. 5, various stages in the delivery of a first filter rod 50, from the hopper delivery drum 32 past the knives 34A and 34B on drum 34, are shown diagrammatically. It should be noted that the rod 50 is of sufficient length to produce exactly six single length component first filter portions. After delivery from the drum 32 the rod 50 is carried under the guide shroud 36 by the drum 34 and the axial position of the rod is established by ribs or guide elements 56 and 58 which projects inwardly from the guide shroud. The cutting knife 34A is positioned so that it severs the rod 50 into a portion 51, having a length of one third that of rod 50, and a remaining portion 52. After cutting, the portion 52 is shifted, as indicated by arrow 60, by a guide element inclined to the plane of rotation of drum 34, until it is axially spaced from the portion 51 by a predetermined amount. The precise axial position of the portion 51 is defined between guide elements 62 and 64 so that the portion may be cut accurately into two equal portions 53 and 54 by cutting knife 34B. After cutting, the portion 54 is shifted axially as indicated by arrow 66. The final axial positions of portions 51, 53 and 54 are shown in FIG. 5C and are determined by guide elements 56, 68, 62, 70, 72 and 74. It should be noted that elements 62, 68, 70 and 72 are each provided with a curved lead-in.

FIG. 6 shows various stages in the delivery of a second filter rod 80, from the hopper delivery drum 40 past the knives 42A, 42B and 42C on drum 42. The rod 80 is of sufficient length to produce exactly six single length component second filter portions. Guides 88 and 90 on the guide shroud 44 ensure that the rod 80 is accurately positioned in relation to the first knife 42A, which divides rod 80 into an end portion 81 of one sixth the length of the rod and a remaining portion 82. As the drum 42 rotates the portion 82 is axially shifted, as indicated by arrow 92, by an inclined guide surface on the guide shroud 44, and is positioned between guides 94 and 96. The portion 81 is not shifted and is accurately positioned by guides 98 and 90.

The portion 82 is divided by knife 42B into a portion 83, of two fifths the length of portion 82 and a remaining portion 84. The portion 84 is shifted, as indicated by arrow 100, into a position between guides 102 and 104, while the portion 83 passes forward between guides 106 and 96. The portion 84 is divided by knife 42C into a portion 85, of one third the length of portion 84, and a remaining portion 86. The portion 85 is positioned by guides 102 and 110 while the portion 86 is axially shifted, as indicated by arrow 108, and is then positioned by guides 112 and 114. The final positions of the divided portions of rod 80, viz, 85, 86, 83 and 81 are shown in FIG. 6D and are determined by guide elements 102, 110, 112, 106, 96, 98 and 90. The elements 96, 98, 104, 106, 110, 112 and 114 are each provided with a curved lead-in. It should be noted that the short filter postions 81 and 85 are not axially shifted as such.

Referring now once again to FIG. 3, the cut and spaced filter portions on drum 42 are delivered onto an end closure drum 120. Similarly the portions from drum 34 are also fed onto the drum 120. The axial relationship between the portions on drums 42 and 34 is such that the portions 51, 53 and 54 on drum 34 are delivered into the gaps between portions 85 and 86, 86 and 83, and 83 and 81, respectively. Any clearance gaps remaining between the alternating portions are closed up on the drum, e.g., by inclined guide surfaces, so that an assembly of alternating filter portions similar to that of FIG. 7 is obtained on drum 120.

Figure 4:
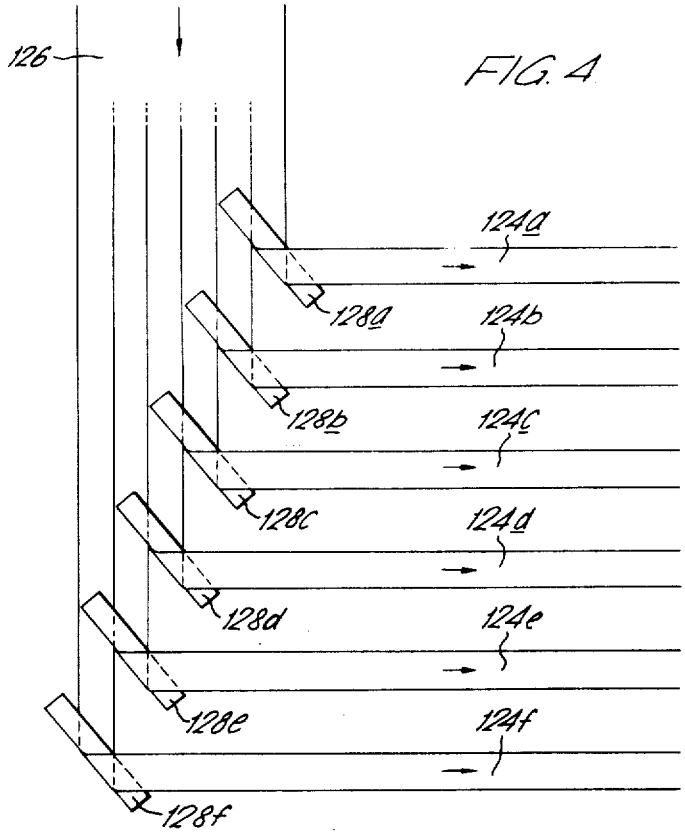
FIG. 4 is a detail plan view of part of the apparatus of FIG. 3.

Each assembly formed on drum 120 is transferred to a suction rolling drum 122 where the assembly is formed into a composite filter rod by wrapping uniting bands around the junctions between the component filter portions of the assembly. The uniting bands are formed from substantially parallel spaced strips 124 of wrapper material fed to the drum 122. The strips are produced from a single web 126 of wrapper material as indicated in FIG. 4. The web 126 is fed through five parallel rotary knives which continuously slit the web longitudinally into six strips 124*a* to 124*f*. The strips 124 are fed individually around parallel turner bars 128*a* to 128*f*, which are spaced in the direction of movement of the strips 124 so that the strips are spaced laterally by a predetermined amount after turning.

FIG. 3 shows the turner bars diagrammatically at 128 and also shows the position of a removable suction band conveyor 130, which is used for setting up the strips 124 between the turner bars 128 and the rolling drum 122 and may be moved away as by a hinged mounting after the strips have been tensioned by the rolling drum.

A paster 132 is provided to apply adhesive to the upper surfaces of the strips 124. Alternatively, the web 126 could be pregummed with a hot-melt adhesive. Preferably this adhesive would be allowed to cool prior to the slitting of the web and reactivated by a heater associated with the rolling drum. If a paster such as 132 is not required the turner bars can be brought closer to the rolling drum so that fewer problems would be involved in setting up or threading prior to starting the apparatus. A suction band or roller may be used adjacent the rolling drum in order to maintain or ensure correct alignment of the strips being fed onto the rolling drum.

The web 126 and strips 124 are fed at a controlled speed which is less than the peripheral speed of rolling drum 122. The strips 124 are disposed in alignment with the junctions between the component filter portions of the filter assembly fed from the drum 120 between the rolling drum and a rolling plate 125. One or more rotary knife carriers 134 cooperate with the rolling drum 122 to divide each strip 124 into lengths of uniting band 124' which, after cutting, are spaced circumferentially on the drum by the differential speed of the drum and the strip. Each uniting band 124' is carried on the drum 122 by suction until it contacts a filter assembly between the rolling plate 125 and the drum, where the band is wrapped around the assembly to join two of the components of the assembly. After rolling, the filter assembly becomes a composite filter rod 136, as shown in FIG. 7, with uniting bands **124'*a* to 124'*f*** joining the component filter portions. Details of a rolling operation using a rolling drum and a rolling plate, whereby rod-like articles in axial abutment are joined, are disclosed in British patent specification No. 886,657.

After rolling, the composite filter rods 136 are delivered to a band 138 which conveys the rods away. In use, the rod 136 would normally be cut at the mid-points of the filter portions 86 and 83 to produce three double length composite filters. Each of these is then positioned between and joined to two tobacco filter lengths and the resulting assembly cut at its mid-point to produce two individual filter cigarettes.

A typical width for the strips 124 would be 6 mm. but with careful attention to alignment of the strips, in relation to the filter assembly, their width could be reduced, say to 4 mm.

It will have been noted that the drums 34 and 42 are required to convey filter portions so that they may be divided by cutting knives and also so that they may be moved axially. This could present some difficulty since the flutes required for conveying rod-like articles through a transverse rotary cutting knife are preferably quite deep whereas those required for conveying articles under guides designed to move the articles axially may be more shallow. One arrangement for overcoming this difficulty is illustrated in FIGS. 8A and 8B.

The Figures show a cutting and spacing drum 150 having an axial flute 152 containing a filter portion 154. The drum has a circumferential slot 156 which extends around the drum, at least in the region between the section of FIG. 8A and that of FIG. 8B, which sections have a relatively small angular separation. The normal depth of the flute 152 is about half the diameter of the filter portion 154. Within the slot 156 are two parallel support elements 158 which are connected to the drum 150 and which locally increase the depth of the flute by extending further up the sides of the portion 154. Thus the elements define a deep U-shaped recess in which the portion 154 lies. As shown in FIG. 8A this controls the filter portion 154 so that it is positively held while being divided by a rotary cutting knife 160 which passes between the support elements 158. The knife 160 extends through a gap in a shroud 162 which surrounds the drum 150.

FIG. 8B shows the position just after cutting. The drum has rotated so that a stationary cam surface 164, disposed between one of the guide elements 158 and the side of the slot 156, has engaged the lower surface of one of the divided filter portions **154*a*. The action of the surface 164 is to lift the end of the portion 154*a* adjacent the elements 158 so that a guide element 166 extending from the shroud 162 can engage the end and begin to shift the portion axially in the flute 152. Once the filter portion 154*a* is clear of the elements 158 and the slot 156 the guide element 166 extends further down towards the surface of the drum 150** and moves the portion axially as the drum rotates.

I claim:

1. Apparatus for making composite filter rod, comprising means to feed successive groups each consisting of several axially aligned component filter portions, said means including at least one conveyor provided with flutes for supporting and conveying filter rods in a direction transverse to their lengths; means for cutting the rods into portions, the flutes of said conveyor being provided with additional lateral support means for said rods in the region where they are cut by said cutting means; means for subsequently axially spacing the portions apart to form a sub-group of component filter portions; means to feed a web of uniting material; slitting means to slit the web continuously longitudinally into a plurality of strips; guide means for changing the directions of travel of said strips and for spacing the strips apart; means for successively cutting portions from the strips to provide a plurality of uniting bands; and means for wrapping the uniting bands around the end portions of each adjacent pair of component filter portions of a group to join said portions into a composite filter rod; wherein the means for axially spacing the portions apart includes at least one stationary guide, including means for displacing a rod in its flute so that it projects beyond said lateral support means for engagement by the stationary guide.

2. Apparatus for making a composite filter rod comprising first and second sources for filter rods, first conveyor means including a first fluted drum for conveying rods from the first source in a direction transverse to their lengths and for cutting the rods into portions and subsequently axially spacing the portions to form a sub-group of component filter portions, second conveyor means including a second fluted drum for conveying rods from the second source in a direction transverse to their lengths and for cutting the rods into portions and subsequently axially spacing the portions to form another sub-group of component filter portions, third conveyor means including a third fluted drum constituting at least part of said means to feed successive groups, said third conveyor means receiving and inter-digitating said sub-groups to form a group, means to feed successive groups consisting of said axially aligned component filter portions, means to feed a web of uniting material, slitting means to slit the web continuously longitudinally into a plurality of strips, guide means for changing the directions of travel of said strips and for laterally spacing the strips apart, said guide means comprising a plurality of coplanar guide elements, one for each strip, which are arranged to engage the strips at spaced positions relative to their directions of travel from the slitting means and turn the strips so that they are delivered along parallel coplanar laterally spaced paths, means for successively cutting portions from the strips to provide a plurality of uniting bands, and means for wrapping the uniting bands around the end portions of each adjacent pair of component filter portions of a group to join said portions into a composite filter rod, and additional lateral support means for the rods in the region where the rods are cut into component filter portions; wherein the conveyors for said sub-groups cooperate with stationary guides for moving axially apart said filter portions, including means for displacing a rod in its flute so that it projects beyond said support means for engagement by a stationary guide.

* * * * *